US007296554B2

(12) United States Patent
Nagel et al.

(10) Patent No.: US 7,296,554 B2
(45) Date of Patent: Nov. 20, 2007

(54) LUBRICATION ASSEMBLY FOR AN ENGINE

(75) Inventors: John J. Nagel, Hartford, WI (US); John A. Zbiegien, Jr., Cedarburg, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 174 days.

(21) Appl. No.: 11/191,632

(22) Filed: Jul. 28, 2005

(65) Prior Publication Data

US 2007/0022998 A1 Feb. 1, 2007

(51) Int. Cl.
*F01M 1/00* (2006.01)

(52) U.S. Cl. ..... 123/196 R

(58) Field of Classification Search ..... 123/196 R; 184/11.1, 13.1

See application file for complete search history.

(56) References Cited

U.S. PATENT DOCUMENTS

| | | | | |
|---|---|---|---|---|
| 4,732,237 | A * | 3/1988 | Nakano | 184/6.5 |
| 4,766,859 | A | 8/1988 | Miyaki et al. | |
| 4,790,273 | A | 12/1988 | Oguri et al. | |
| 5,588,408 | A | 12/1996 | Kurihara | |
| 5,857,441 | A * | 1/1999 | Yonezawa et al. | 123/196 R |
| 5,887,678 | A | 3/1999 | Lavender | |
| 5,950,590 | A * | 9/1999 | Everts et al. | 123/196 R |
| 6,119,648 | A * | 9/2000 | Araki | 123/196 R |
| 6,227,160 | B1 * | 5/2001 | Kurihara et al. | 123/196 R |
| 6,283,084 | B1 * | 9/2001 | Nagai et al. | 123/196 R |
| 6,561,315 | B2 | 5/2003 | Furuya et al. | |
| 6,629,517 | B2 * | 10/2003 | Honda | 123/196 R |
| 6,715,461 | B2 * | 4/2004 | Ito et al. | 123/196 R |
| 6,810,849 | B1 | 11/2004 | Hirsch et al. | |
| 2005/0139186 | A1 * | 6/2005 | Furuya | 123/196 R |

* cited by examiner

*Primary Examiner*—Stephen K. Cronin
*Assistant Examiner*—Jason Benton
(74) *Attorney, Agent, or Firm*—Michael Best & Friedrich LLP

(57) ABSTRACT

In one embodiment, the invention provides an internal combustion engine including an engine housing having a crankcase defining a crank chamber adapted to contain a lubricant. The engine also includes a crankshaft coupled to the engine housing for rotation about a crank axis, the crankshaft disposed within the crank chamber, and a counterweight disposed on the crankshaft for rotation with the crankshaft about the crank axis. The engine further includes a splasher disposed on the crankshaft for rotation with the crankshaft about the crank axis. The splasher is adapted to direct the lubricant in a radial direction away from the crank axis and in an axial direction substantially parallel to the crank axis during rotation of the crankshaft.

21 Claims, 8 Drawing Sheets

LUBRICATION ASSEMBLY FOR AN ENGINE

BACKGROUND

The present invention relates to a four-cycle engine comprising a piston that reciprocates in a horizontally oriented cylinder and drives a vertically oriented crankshaft.

SUMMARY

In one embodiment, the invention provides an internal combustion engine including an engine housing having a crankcase defining a crank chamber adapted to contain a lubricant. The engine also includes a crankshaft coupled to the engine housing for rotation about a crank axis, the crankshaft disposed within the crank chamber, and a counterweight disposed on the crankshaft for rotation with the crankshaft about the crank axis. The engine further includes a splasher disposed on the crankshaft for rotation with the crankshaft about the crank axis. The splasher is adapted to direct the lubricant in a radial direction away from the crank axis and in an axial direction substantially parallel to the crank axis during rotation of the crankshaft.

In another embodiment, the invention provides an internal combustion engine including an engine housing having a cylinder and a crankcase, the crankcase defining a crank chamber adapted to contain a lubricant. The engine includes a piston slidably received within the cylinder, and a crankshaft coupled to the engine housing for rotation about a crank axis, the crankshaft disposed within the crank chamber. The piston is coupled to the crankshaft. The engine housing also includes a counterweight disposed on the crankshaft for rotation with the crankshaft about the crank axis. Rotation of the counterweight generates forces opposite the forces generated by reciprocation of the piston within the cylinder. The counterweight includes symmetrical extended portions and a gap separating each of the extended portions.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
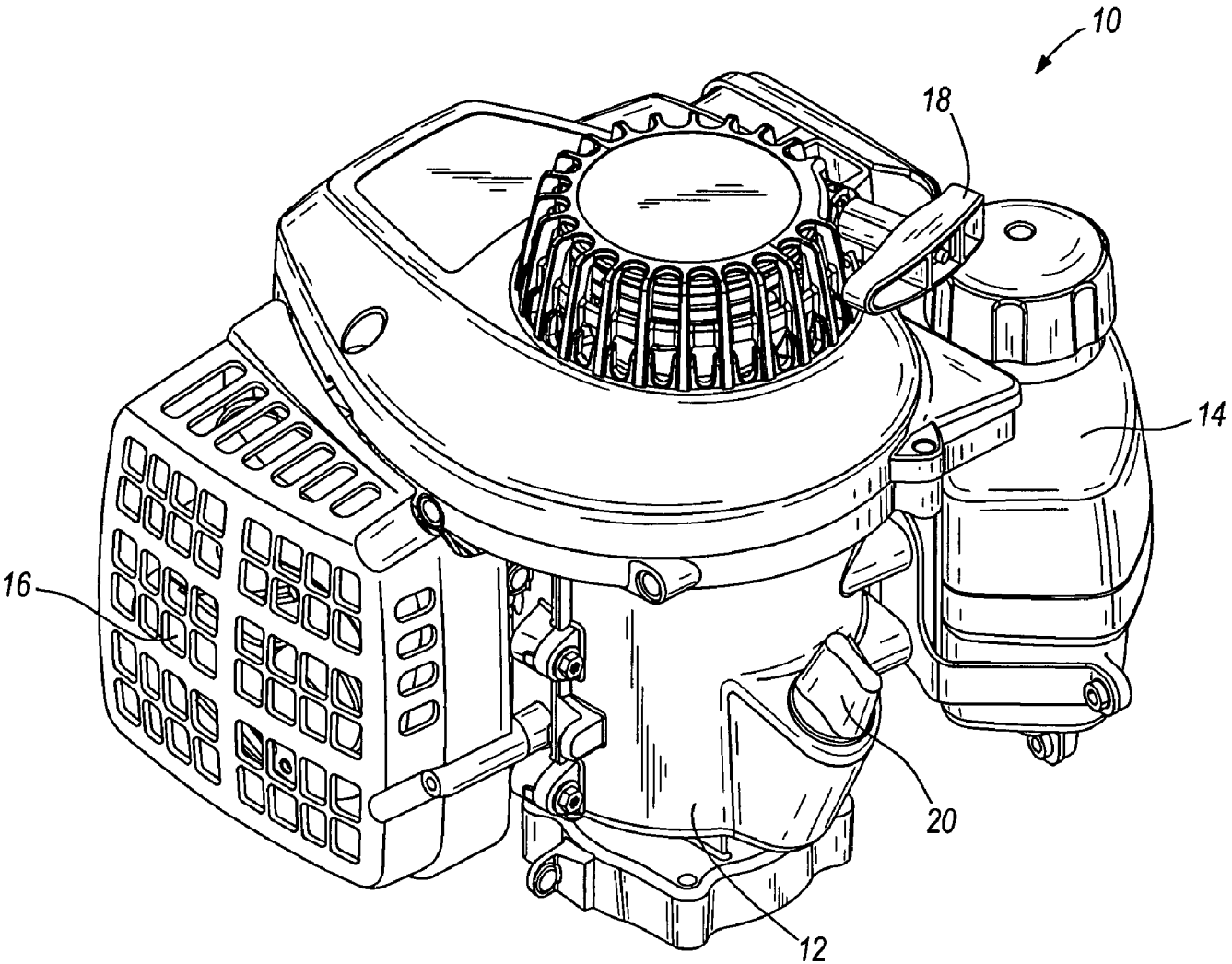
FIG. 1 is a perspective view of a four-cycle, vertical-shaft engine embodying the present invention.

FIG. 1 illustrates a single-cylinder, four-cycle, vertical-shaft internal combustion engine 10. A vertical-shaft engine is one in which the crankshaft is oriented vertically and the piston is oriented horizontally in the typical operating position of the engine. The most typical application for an engine of this type is powering a lawnmower, but it could be adapted for any situation in which a vertically oriented crankshaft is required. For example, the engine could be used to power other lawn and garden equipment, outdoor power equipment, augers, cultivators, a pump of a pressure washer or to power a generator.

The engine 10 includes an engine housing 12, a fuel tank 14, a muffler 16, a pull-start mechanism 18, and an oil dipstick 20. The engine housing 12 defines a crank chamber 22 (FIG. 3) which is adapted to at least partially rotatably support a crankshaft assembly 24 (FIG. 5). The crankshaft assembly 24 defines and is adapted to rotate about a crank axis 26 (FIG. 4).

Figure 2:
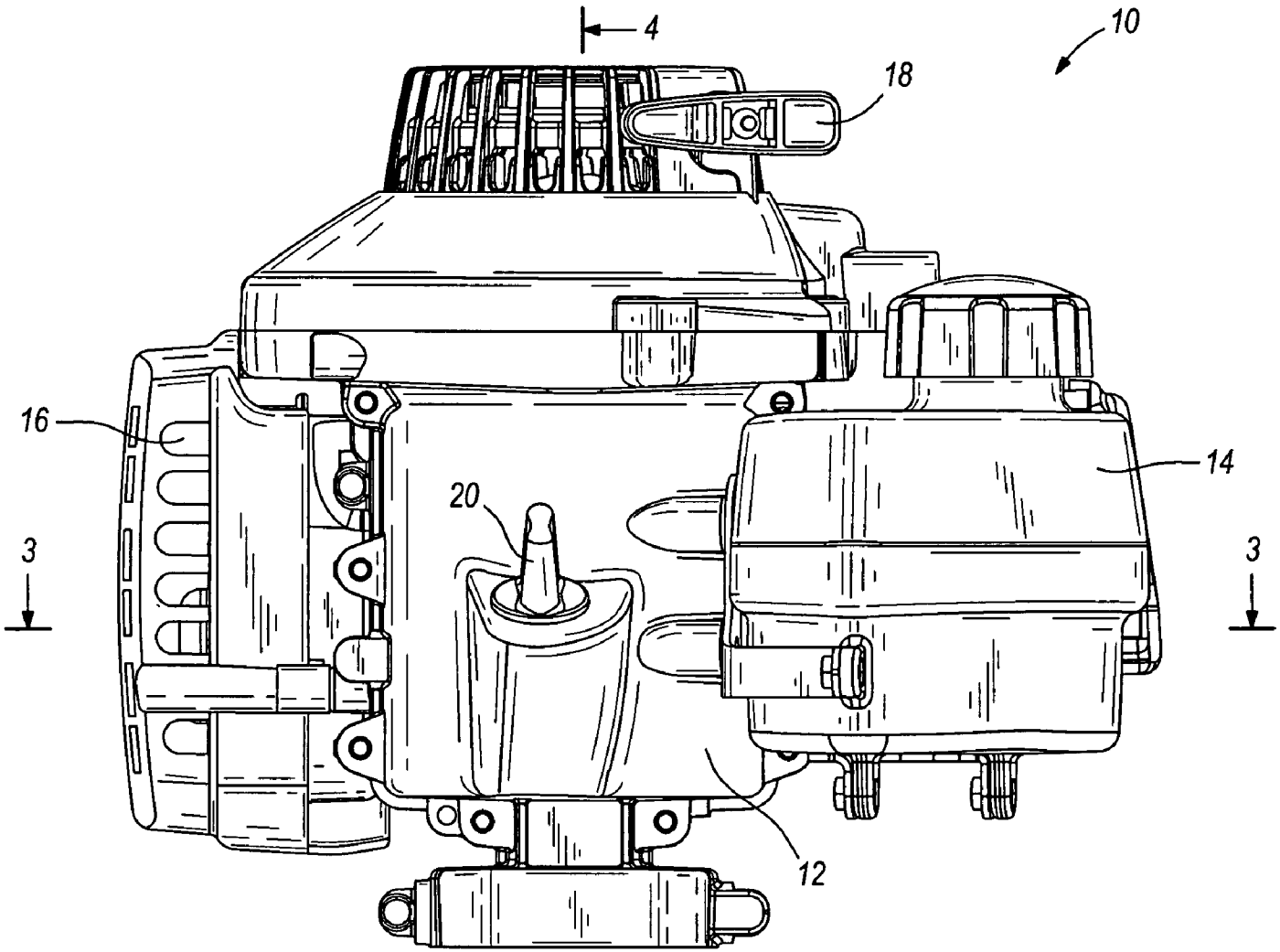
FIG. 2 is a side view of the engine of FIG. 1.
Figure 3:
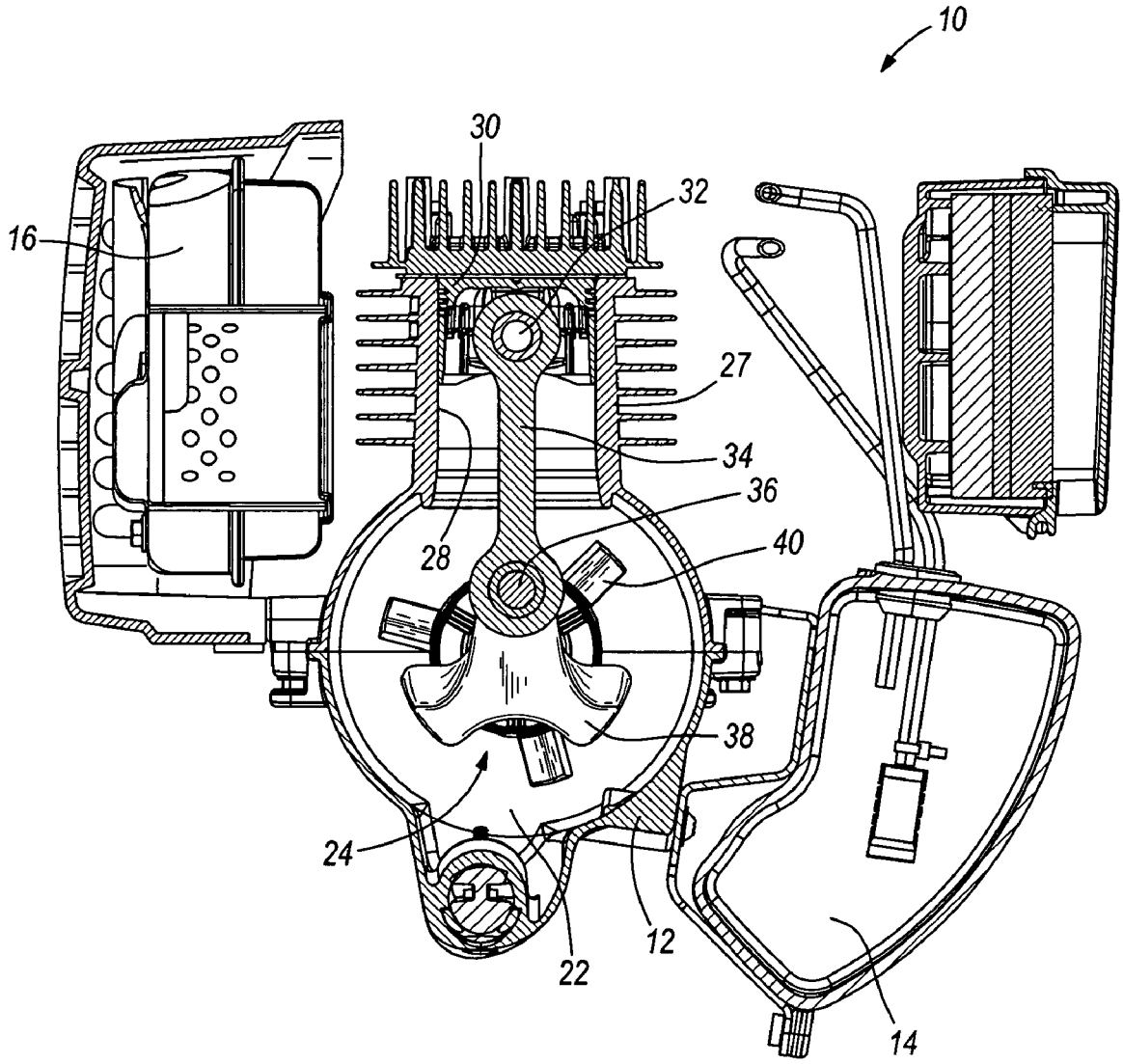
FIG. 3 is a section view taken along line 3-3 of FIG. 1, illustrating a counterweight and splasher of a crankshaft assembly.

FIG. 2 depicts a side view of the engine 10. FIG. 3 is a section view of the engine 10 taken along line 3-3 of FIG. 2. A cylinder 27 is defined by the engine housing 12 and includes a cylinder bore 28 adapted to slidably receive a piston 30 for reciprocation. The piston 30 includes a wrist pin 32, which is rotatably connected to a first end of a connecting rod 34. A second end of the connecting rod 34 is rotatably supported by a crank pin 36. Also visible in FIG. 3 is a crankshaft counterweight 38 rigidly affixed to the crank pin 36, and a lubricant splasher 40.

Figure 4:
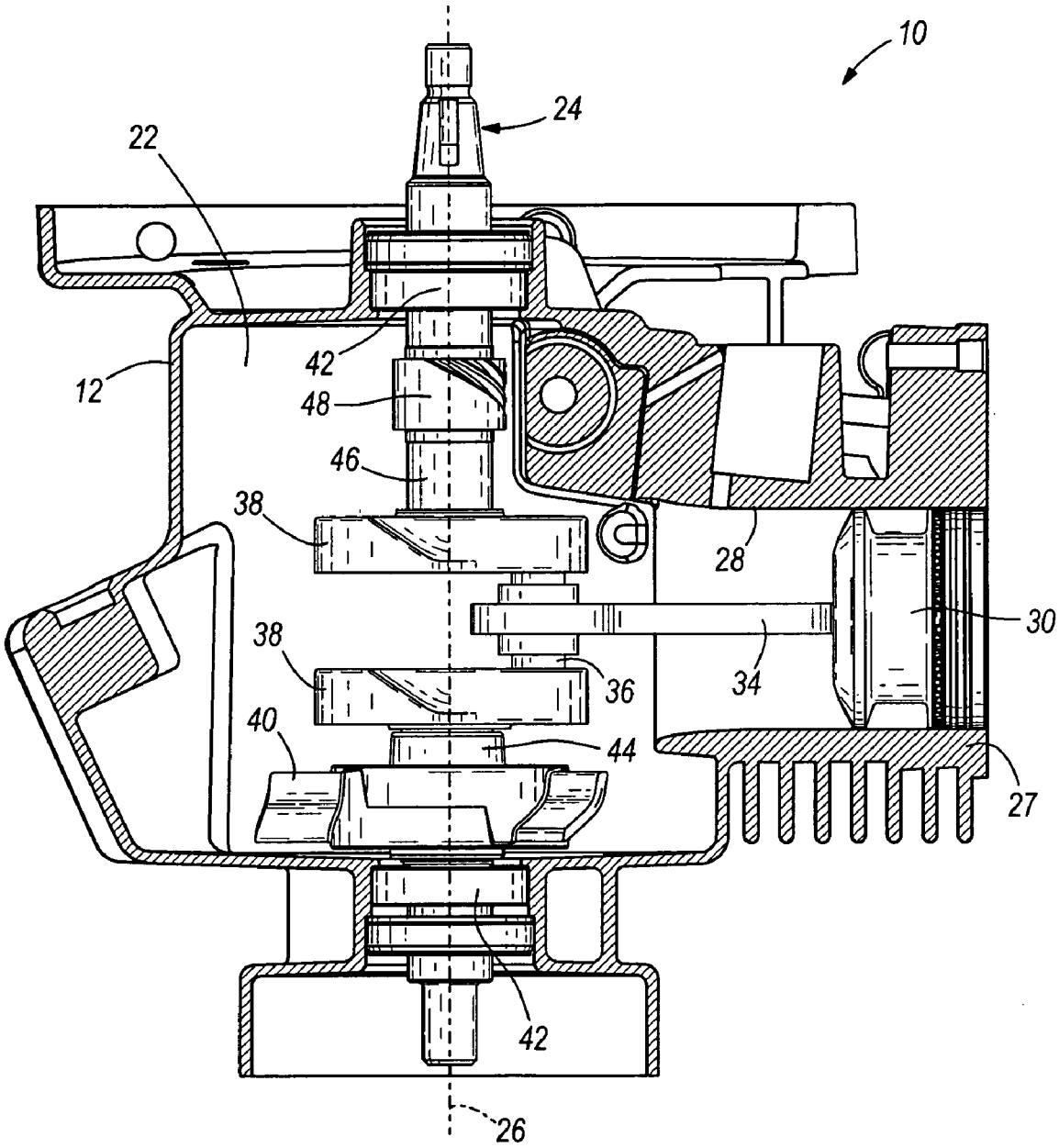
FIG. 4 is a cross section taken along line 4-4 of FIG. 1, illustrating the crankshaft assembly.
Figure 5:
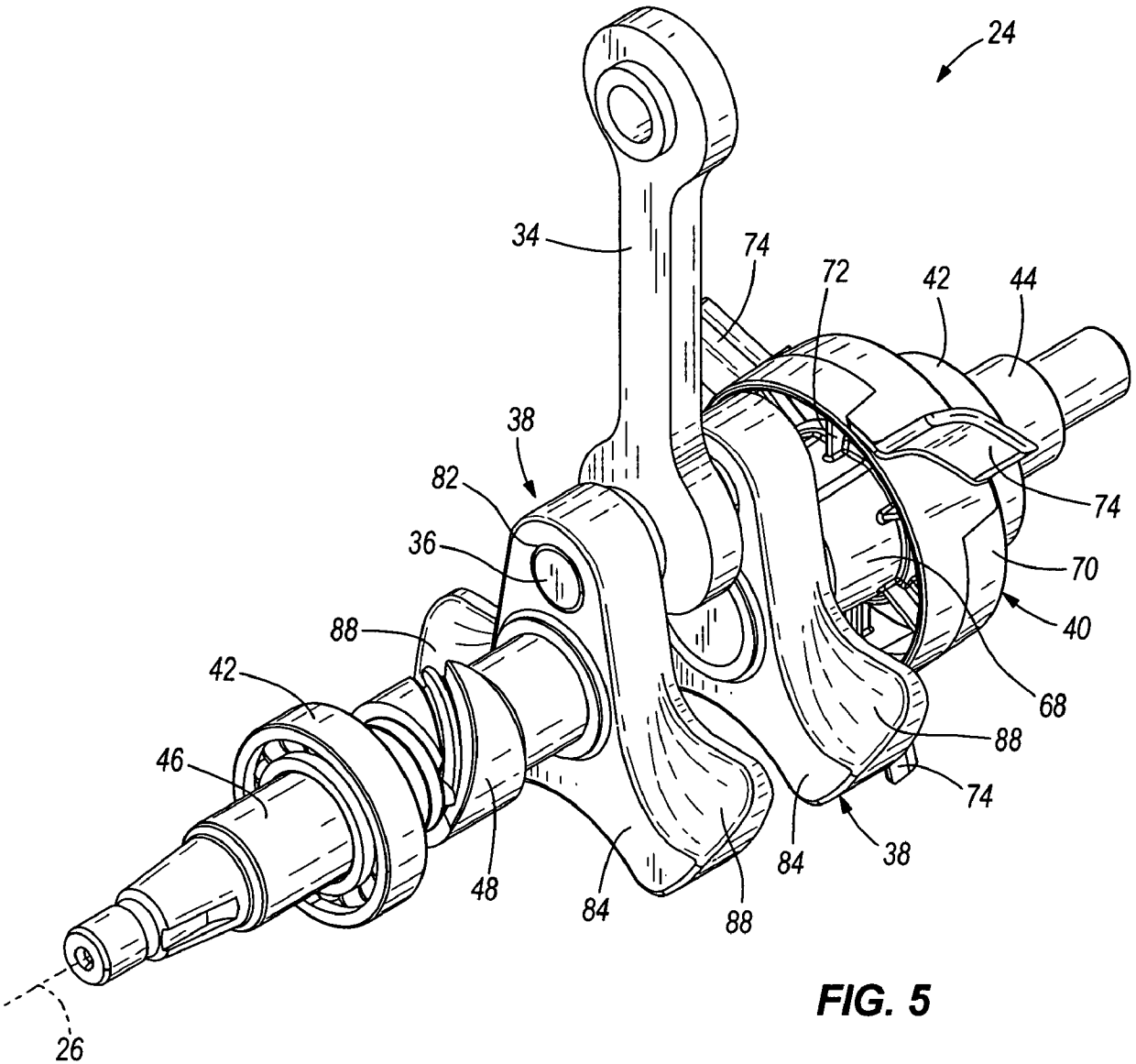
FIG. 5 is a perspective view of the crankshaft assembly of FIG. 4.

FIG. 4 is a section view of the engine 10 taken along line 4-4 of FIG. 2, illustrating the crankshaft assembly 24 rotatably supported in the engine housing 12 by bearings 42 journaled on either end of the crankshaft assembly 24. The crankshaft assembly 24 includes a first shaft portion 44 and a second shaft portion 46.

Figure 6:
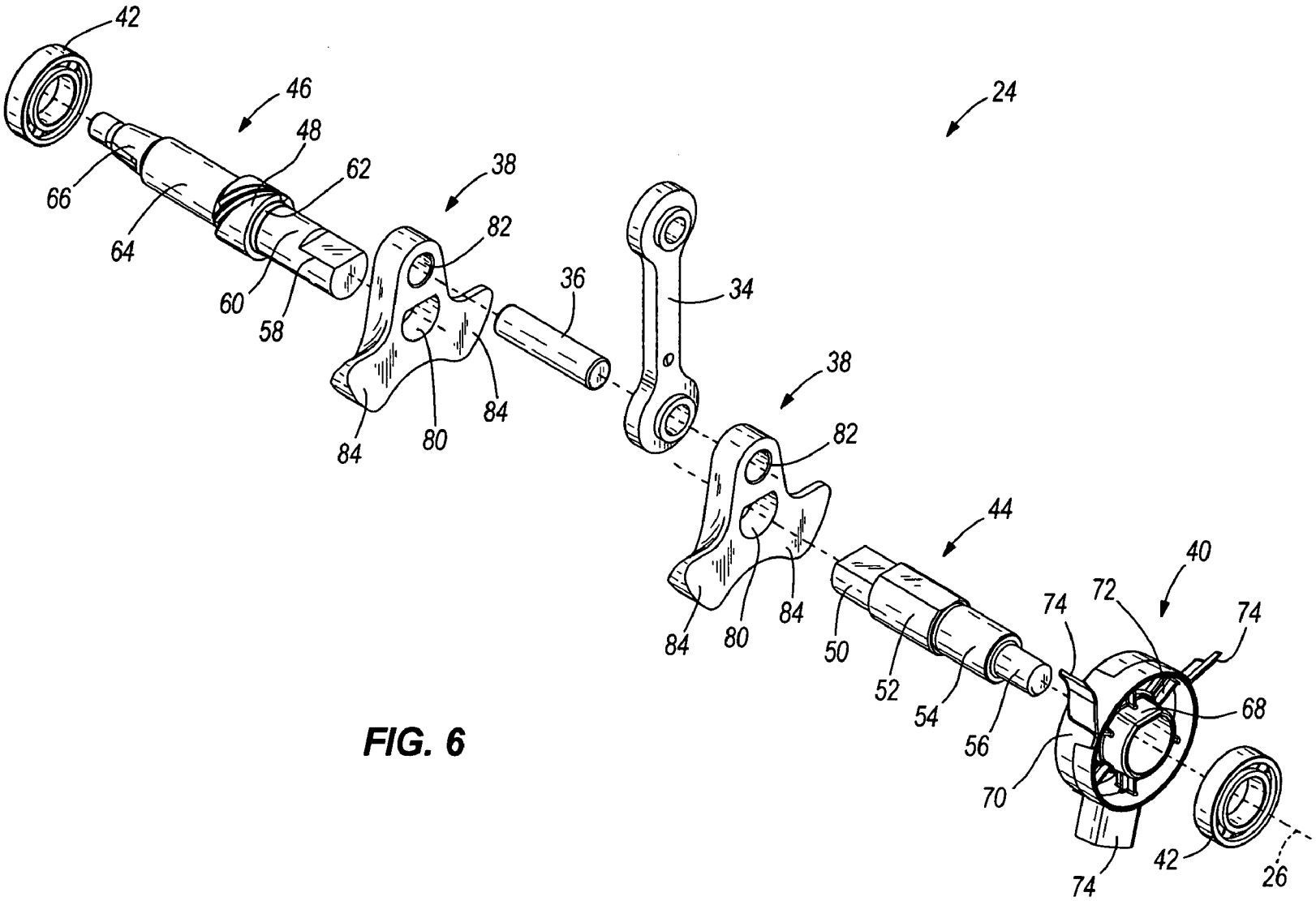
FIG. 6 is an exploded view of the crankshaft assembly of FIG. 4.

FIG. 5 is a perspective view of the crankshaft assembly 24, and FIG. 6 is an exploded view of the crankshaft assembly 24. The crankshaft assembly 24 includes the two bearings 42, the lubricant splasher 40, which is journaled on the first shaft portion 44, two counterweights 38, one of which is journaled on the first shaft portion 44, the other of which is journaled on the second shaft portion 46, the crank pin 36, the connecting rod 34, and a bevel gear 48. The first and second shaft portions 44, 46 define the crank axis 26.

In FIG. 6, the first shaft portion 44 has four distinct profiles along its length. The first profile 50 has a "D" shape, meaning it is cylindrical except for a planar portion truncating the cylindrical circumference. The second profile 52 is also "D" shaped, but has a larger diameter than the first profile 50. A "D" shaped profile on a shaft allows for other components with a matching profile to be journaled on the shaft in only one orientation, and also resists rotation of the component with respect to the shaft. The third and fourth profiles 54, 56 are cylindrical, the third profile 54 having a larger diameter than the fourth profile 56.

The second shaft portion 46 has five distinct profiles. The first profile 58 is "D" shaped and is preferably substantially identical to the first profile 50 of the first shaft portion 44. The second profile 60 is cylindrical, and is preferably substantially identical to the fourth profile 64. The third profile 62 is cylindrical, and has a larger diameter than the second profile 60. The fifth profile 66 has a generally conical shape with a groove parallel to the crank axis 26.

Figure 7:
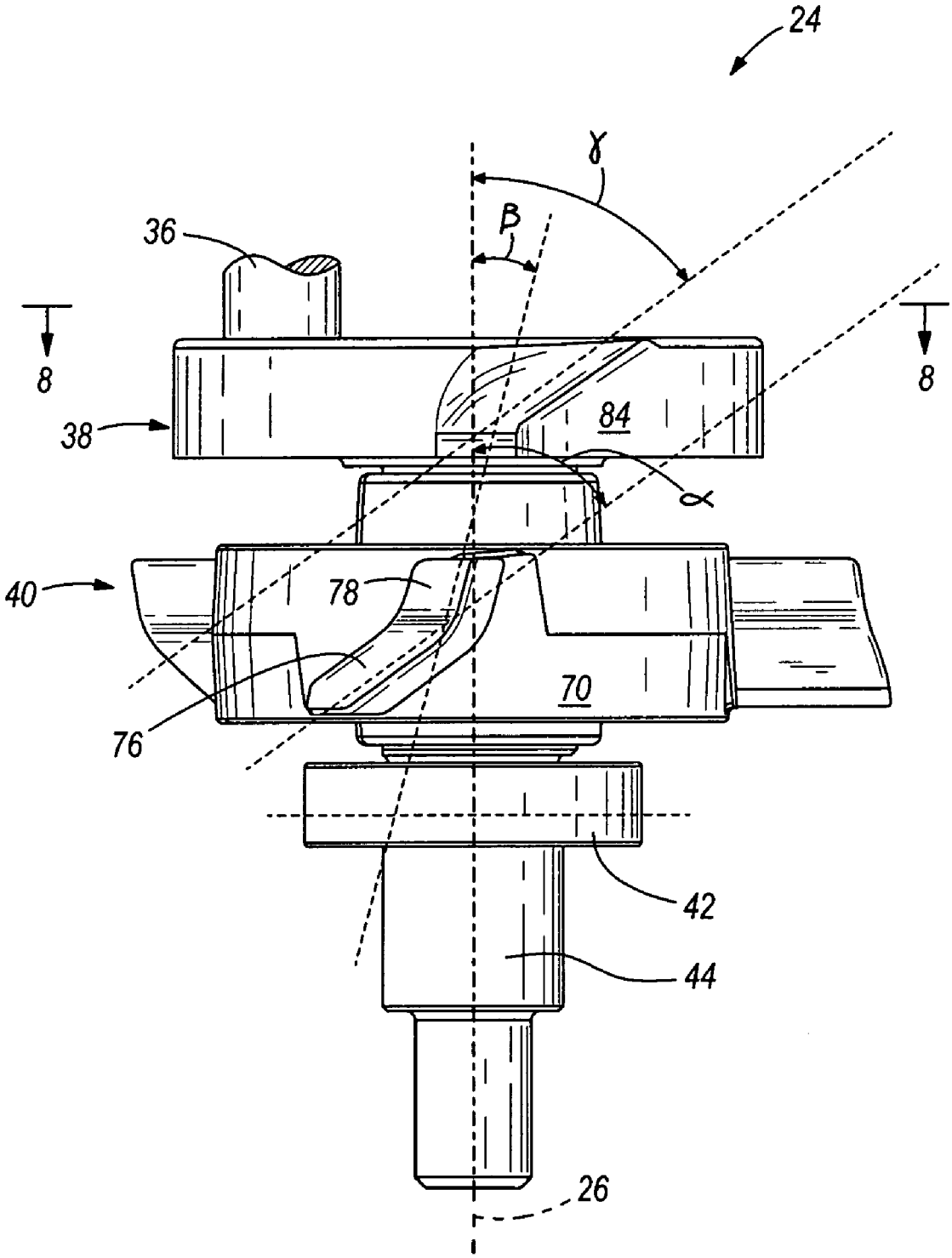
FIG. 7 is a side view of a portion of the crankshaft assembly of FIG. 4, illustrating the splasher and the counterweight.

The lubricant splasher 40 is journaled on the second profile 52 of the first shaft portion 44 for rotation with the crankshaft assembly 24 about the crank axis 26. The splasher 40 includes a substantially cylindrical inner shell 68 disposed on the first shaft portion 44, and an outer cylindrical shell 70 coupled to the inner shell 68 by a plurality of ribs 72. The inner shell 68 has a non-circular inner profile substantially identical to the second profile 52 of the first shaft portion 44. The splasher 40 also includes a plurality of paddles 74 disposed about its outer shell 70. Each of the paddles 74 includes first and second adjacent faces 76, 78 oriented at angles $\alpha$, $\beta$ from the crank axis 26 (FIG. 7). The first face 76 is oriented at the included angle $\alpha$ from the crank axis 26. The second face 78 is oriented at the smaller included angle $\beta$ from the crank axis 26. During rotation of the splasher 40 under normal operating conditions, the first face 76 of each paddle 74 splashes lubricant radially away from the crank axis 26, and the second face 78 splashes lubricant axially in the direction of the crank axis 78. It should be noted that the number of paddles 74 can vary for other embodiments. Although three paddles 74 are shown in the figures, this is for illustrative purposes only. The splasher 40 is a single piece of injection-molded plastic that can be molded from nylon or other polymer.

Each counterweight 38 includes a central aperture 80 that has a profile identical to the first profile 50, 58 of the first and second shaft portions 44, 46. The first counterweight 38 is journaled on the first profile 50 of the first shaft portion 44 and the second counterweight 38 is journaled on the first profile 58 of the second shaft portion 46. Each counterweight 38 has an aperture 82 near one end adapted to receive the crank pin 36, which connects the two counterweights 38. The counterweights 38 include a pair of symmetrical extended portions 84 with a gap 86 between them. Each of the extended portions 84 has a ramped face 88 disposed at an angle $\gamma$ from the crank axis 26 (FIG. 7).

The primary function of the counterweights 38 is to balance forces imposed on the crankshaft assembly 24 from the reciprocating action of the piston 30. Additionally, the gap 86 between the extended portions 84 of the counterweights 38 allows lubricant splashed in the axial direction to land on the bevel gear 48 and the bearing 42 journaled on the second shaft portion 46. To enhance this feature, the gap 86 is aligned with a paddle 74 on the splasher 40 (FIG. 8) to promote splashing of lubricant in the axial direction through the gap 86.

The bevel gear 48 is journaled on the third profile 62 of the second shaft portion 46. The bevel gear 48 matches a bevel gear disposed on a cam shaft (not shown). The cam shaft is rotatably supported by the engine housing 12, and defines a cam axis about which it rotates. The cam axis is oriented normal to the crank axis 26, and the cam shaft is rotatably driven by the bevel gear 48 on the crankshaft assembly 24.

FIG. 7 is a side view of the crankshaft assembly 24, focusing on the lubricant splasher 40 and one counterweight 38. The drawing illustrates the angle $\alpha$ of the first face 76 of each paddle 74 is approximately 55 degrees from the crank axis 26, while the angle $\beta$ of the second face 78 is approximately 15 degrees from the crank axis 26. The drawing also illustrates the ramped surface 88 of the counterweight extended portions 84. The angle $\gamma$ of the ramped surface 88 is approximately 55 degrees from the crank axis 26. Angles $\alpha$ and $\gamma$ are independent, and do not necessarily need to be similar angles. It should be noted angles $\alpha$ and $\gamma$ may range from approximately 45 degrees to 65 degrees, and angle $\beta$ may range from approximately 5 degrees to 25 degrees, and still permit the splasher to serve the same function.

The splasher 40 will function properly while the engine 10 operates at engine speeds ranging from about 3200 to 8500 rpm. The splasher 40 will also function properly while the vertically oriented crankshaft assembly 24 is continuously tilted up to 25 degrees and intermittently tilted to 30 degrees from vertical. For the splasher 40 to effectively splash lubricant to the bearings 42 and bevel gear 48, at least 5 percent of the splasher 40 must be in contact with the lubricant stored in the crank chamber 22 even if the engine 10 is operating while tilted as stated earlier. This is accomplished by storing a volume of lubricant ranging from 40 to 100 cubic centimeters in the crank chamber 22.

Figure 8:
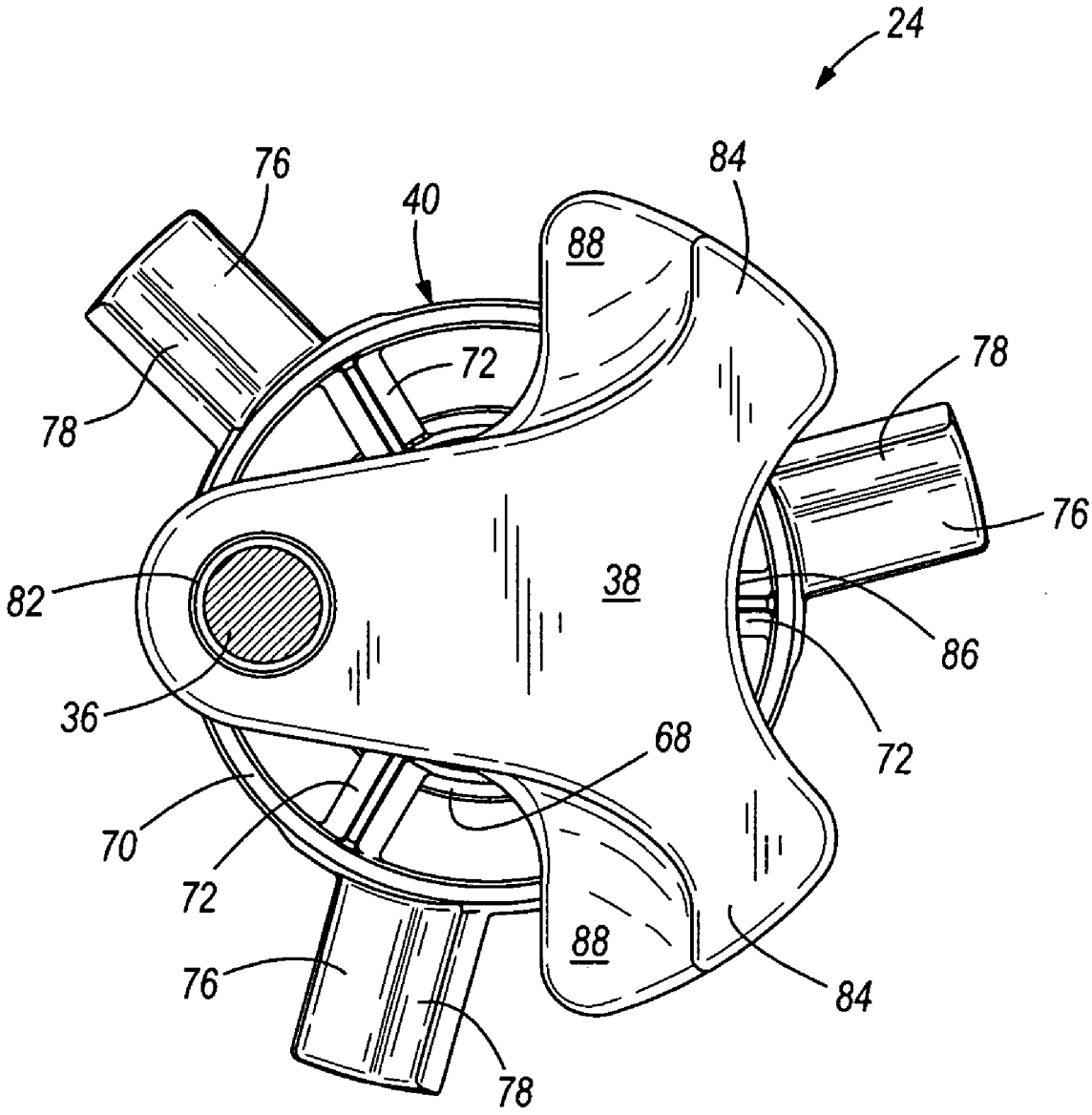
FIG. 8 is a cross-section view taken along line 8-8 of FIG. 7, illustrating a gap between extended portions of the counterweight.

FIG. 8 is a section view of the crankshaft assembly 24 viewed along the crank axis 26. The section is taken about the crank pin 36. It is visible from this perspective how the gap 86 between the extended portions 84 of the counterweight 38 allows splashed lubricant to travel in the axial direction with less interference from the counterweight 38. It is also visible how the ramped portions 88 of the counterweight 38 help direct the splashed lubricant.

Thus, the invention provides, among other things, a new and useful crank shaft assembly for a four-cycle, vertical-shaft engine. More particularly, the invention provides a new and useful crank shaft assembly that includes a lubricant splasher and counterweights including symmetrical extended portions that operate together to allow lubricant to be splashed to critical lubrication points in the crank chamber. Various features and advantages of the invention are set forth in the following claims.

What is claimed is:

1. An internal combustion engine comprising:

an engine housing including a crankcase defining a crank chamber adapted to contain a lubricant;

a crankshaft coupled to the engine housing for rotation about a crank axis, the crankshaft disposed within the crank chamber;

a counterweight disposed on the crankshaft for rotation with the crankshaft about the crank axis; and a splasher disposed on the crankshaft for rotation with the crankshaft about the crank axis, the splasher adapted to direct the lubricant in a radial direction away from the crank axis and in an axial direction substantially parallel to the crank axis during rotation of the crankshaft;

wherein the splasher includes a substantially cylindrical inner shell disposed on the crankshaft and an outer cylindrical shell coupled to the substantially cylindrical inner shell by a plurality of ribs.

2. The engine of claim 1, wherein the inner cylindrical shell has a non-circular inner profile substantially identical to a profile of a region of the crankshaft.

3. The engine of claim 2, wherein the inner cylindrical shell is journaled on the region of the crankshaft with the substantially identical profile.

4. An internal combustion engine composing:

an engine housing including a crankcase defining a crank chamber adapted to contain a lubricant;

a crankshaft coupled to the engine housing for rotation about a crank axis, the crankshaft disposed within the crank chamber;

a counterweight disposed on the crankshaft for rotation with the crankshaft about the crank axis; and a splasher disposed on the crankshaft for rotation with the crankshaft about the crank axis, the splasher adapted to direct the lubricant in a radial direction away from the crank axis and in an axial direction substantially parallel to the crank axis during rotation of the crankshaft;

wherein the splasher includes at least one paddle disposed about an outer surface of the splasher, wherein the at least one paddle includes a first face disposed at a first included relative angle from the crank axis and a second face disposed at a second smaller included relative angle from the crank axis, the first and second faces designed to splash lubricant in the radial and axial directions, respectively.

5. The engine of claim 2, wherein the first included angle is between approximately 45-65 degrees.

6. The engine of claim 2, wherein the second included angle is between approximately 5-25 degrees.

7. The engine of claim 2, wherein the first included angle is between approximately 45-65 degrees and the second included angle is between approximately 5-25 degrees.

8. The engine of claim 2, wherein the counterweight comprises symmetrical extended portions and a gap separating the extended portions, and wherein the splasher is oriented relative to the counterweight to allow lubricant splashed from the at least one paddle in the axial direction to travel through the gap between the extended portions of the counterweight.

9. The engine of claim 1, wherein the splasher includes injection-molded plastic.

10. The engine of claim 1, wherein the splasher is positioned in the crank chamber and is adapted to be at least partially submerged in the stored lubricant.

11. An internal combustion engine, comprising:

an engine housing including a crankcase and a cylinder, the crankcase defining a crank chamber adapted to contain a lubricant;

a piston slidably received within the cylinder;

a crankshaft coupled to the engine housing for rotation about a crank axis, the crankshaft disposed within the crank chamber and the piston coupled to the crankshaft; and a counterweight disposed on the crankshaft for rotation with the crankshaft about the crank axis, wherein rotation of the counterweight generates forces opposite the forces generated by reciprocation of the piston within the cylinder, the counterweight comprising symmetrical extended portions spaced from each other in a circumferential direction, and a gap separating each of the extended portions.

12. The engine of claim 11, wherein the counterweight further comprises an aperture with a non-circular inner profile substantially identical to a profile of a region of the crankshaft, and wherein the counterweight is journaled on the region of the crankshaft with the substantially identical profile.

13. The engine of claim 11, further comprising a lubricant splasher disposed on the crankshaft for rotation with the crankshaft about the crank axis.

14. The engine of claim 13, wherein the splasher includes at least one paddle disposed about a circumference of an outer cylindrical surface, wherein a first face of the at least one paddle is disposed at a first included angle from the crank axis and a second face of the at least one paddle is disposed at a second smaller included angle from the crank axis, the first and second faces designed to splash lubricant in respective radial and axial directions.

15. The engine of claim 14, wherein the splasher is oriented relative to the counterweight to allow lubricant splashed from the at least one paddle in the axial direction to travel through the gap between the extended portions of the counterweight.

16. The engine of claim 13, wherein the splasher is positioned in the crank chamber and is adapted to be at least partially submerged in the stored lubricant.

17. The engine of claim 11, wherein the extended portions of the counterweight have ramped surfaces.

18. The engine of claim 17, wherein the ramped surfaces of the extended portions are adapted to direct lubricant.

19. The engine of claim 17, wherein each of the ramped surfaces defines an angle of between approximately 45-65 degrees relative to the crank axis.

20. The engine of claim 17, wherein the ramped surfaces are in an opposite facing relationship to each other.

21. The engine of claim 17, wherein the counterweight has an aperture adapted to receive a wrist pin.

* * * * *